US005150873A

United States Patent [19]

Donovan

[11] Patent Number: 5,150,873

[45] Date of Patent: Sep. 29, 1992

[54] PORTABLE AUXILIARY DESK TOP ARTICLE

[76] Inventor: James M. Donovan, 7821 Laurel Ave., Cincinnati, Ohio 45243

[21] Appl. No.: 701,106

[22] Filed: May 16, 1991

[51] Int. Cl.[5] ..... A47B 97/00

[52] U.S. Cl. ..... 248/460; 248/447.1; 248/453; 248/441.1

[58] Field of Search ..... 248/460, 451, 441.1, 248/452, 458, 447.1, 447.2, 447, 448, 453, 455; 108/44

[56] References Cited

U.S. PATENT DOCUMENTS

| | | | |
|---|---|---|---|
| 336,613 | 2/1886 | Worrall | 248/451 |
| 453,722 | 6/1891 | Baker | 248/452 |
| 822,691 | 6/1906 | Pashley | 248/452 |
| 1,219,393 | 3/1917 | Harrison | 248/455 |
| 1,524,767 | 1/1924 | Vandervoort . | |
| 2,080,591 | 5/1937 | Wright | 248/452 X |
| 4,699,346 | 10/1987 | Bahm | 248/454 |
| 4,749,161 | 6/1988 | Falcone | 248/459 X |
| 4,754,945 | 7/1988 | Diamond | 248/447 X |
| 4,779,365 | 10/1988 | Theeten | 38/135 |
| 4,865,286 | 9/1989 | Clayburn | 748/460 |
| 4,969,623 | 11/1990 | Bernier | 248/441.1 |

FOREIGN PATENT DOCUMENTS

| | | | |
|---|---|---|---|
| 1383609 | 2/1975 | United Kingdom | 248/447.1 |
| 2174949 | 11/1986 | United Kingdom . | |

*Primary Examiner*—Alvin C. Chin-Shue
*Attorney, Agent, or Firm*—Charles R. Wilson

[57] ABSTRACT

A portable auxiliary desk top article is constructed for temporary positioning onto a work surface arm of a student desk to enlarge the desk's work surface area. The article comprises a first substantially rigid flat surface member and a second substantially rigid flat surface member hingeably attached together. A pocket structure is attached to an underside of one of the flat surface members. The pocket structure is open-sided on two sides and is intended to fit over the work surface arm of the student desk to hold the article in place. When folded out, the flat surface members present an enlarged work surface area for the student, significantly larger than that provided by the work surface arm of the desk.

19 Claims, 1 Drawing Sheet

PORTABLE AUXILIARY DESK TOP ARTICLE

This invention relates to an article for use with a student desk. More particularly, the invention relates to a portable auxiliary desk top article for use on a student desk to enlarge its work surface area.

Modern day desks used extensively throughout many colleges and high schools have a common design. The school desks basically all have a unitary structure comprising a chair portion and a work surface arm portion. The work surface arm portion presents a flat surface to hold books and work papers as well as to serve as an arm rest. The chair and work surface arm portions are permanently attached together. The student desks are relatively inexpensive, durable and reasonably comfortable. Certainly, the student desk strikes a balance between cost and functionality.

Most student desks are built with a minimal work surface area. Thus, the flat work surface on the arms of the desks are capable of holding a book and perhaps a writing tablet. The small work surface area can be attributed to economy, but more likely is needed to keep the student desks stackable during storage or when temporarily moved aside such as for routine floor cleaning. Students over the years have learned to cope to a certain extent with the small work surface area on the student desk.

There is a need for a student desk design which would permit a large work surface area. Unfortunately, any student desk built with a large work desk area will have consequent disadvantages such as increased cost, greater weight and consequent less mobility, etc.

In accord with a need for an improved student desk design, there has been developed an auxiliary desk top article which is useable with existing student desks. The auxiliary desk top article is portable and when used on a student desk enlarges the work surface area of the desk.

SUMMARY OF THE INVENTION

A portable auxiliary desk top article comprises a first substantially rigid flat surface member hingeably connected to a second substantially rigid flat surface member. A pocket structure is attached to an underside of one of the flat surface members. The pocket structure is open-sided on two sides and is dimensioned to slip over a work surface arm portion of a typical student desk. The first and second flat surface members when opened out present a relatively large work surface area. The auxiliary desk top article when removed from the student desk and closed forms a compact article which is very portable in nature. A book prop and pencil holder are optional features which can be present.

DETAILED DESCRIPTION OF THE INVENTION

The portable auxiliary desk top article of the invention is described with reference to the drawings. While described in conjunction with its use on a typical student desk, it should be understood the auxiliary desk top article is useable on other student desk models with little if any dimensional changes.

Figure 1:
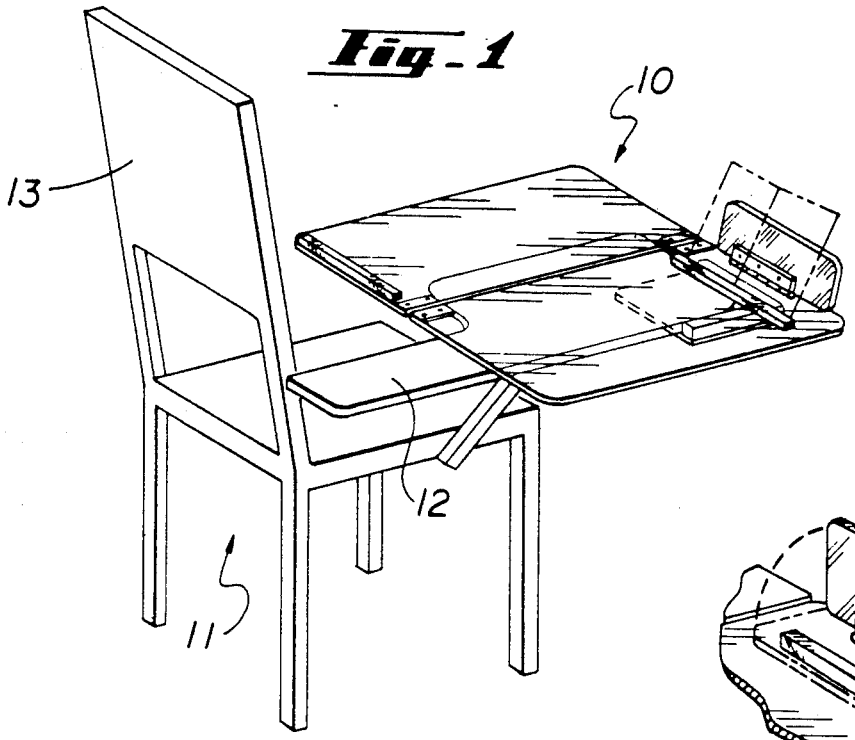
FIG. 1 an environmental view in perspective showing the portable auxiliary desk top article of the invention on a typical student desk.

With reference to FIG. 1, a portable auxiliary desk top article 10 is shown positioned on a student desk 11. The auxiliary desk top article lo is fully opened. It is positioned over the student desk's work surface arm 12 and approximately doubles the size of the available work surface area. Use of the chair portion 13 of the student desk is not effected by the desk top article 10.

Figure 2:
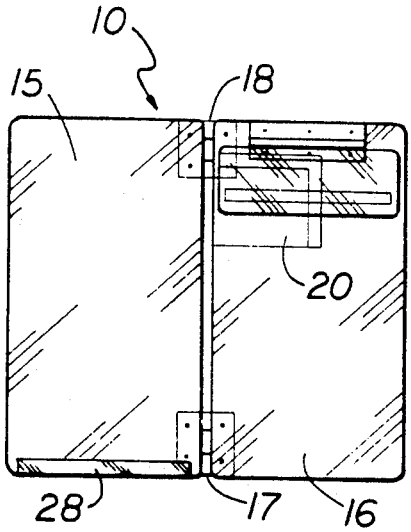
FIG. 2 is a top view of the portable auxiliary desk top article of FIG. 1 in an opened state.
Figure 4:
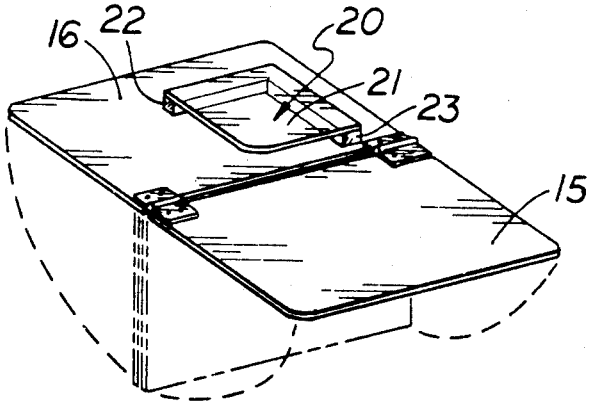
FIG. 4 is bottom view in perspective of the portable auxiliary desk top article of FIG. 1 showing a pocket structure.

As best seen in FIGS. 2 and 4, the portable auxiliary desk top article 10 of the invention has a first substantially rigid flat surface member 15 and a second substantially rigid flat surface member 16. The flat surface members depicted are made of a transparent rigid polymeric material. The transparent material is preferred in that it aids in positioning of the desk top article on the work surface arm of the desk top as further discussed below. However, other rigid materials which can be translucent or opaque are also useful in the invention.

The first and second surface members 15 and 16 are hingeably connected along a longitudinal edge of each. As shown, butt hinges 17 and 18 are spaced on the inside longitudinal edges of each of the two members. The hinges are surface mounted, though for appearance purposes preferably mortises are provided in the surface members and the hinges so mounted. The hinges open at least 180 degrees and can open a full 360 degrees. In use the first and second flat surface members are folded out to present a large flat work surface. When in storage or being transported, the first and second flat surface members are folded together to effectively halve the width of the article.

Other hinging means can be used to hingeably attach the first and second flat surface members. For example, a strip of a flexible polymeric material is cut to have a length approximate that of each member and then adhered near each of the strip's edges to near the inside edge of the first flat surface member and near the inside edge of the second flat surface member. Any flexible polymeric material capable of withstanding repeated flexings is usable. Other hinging means such as continuous hinges are as well useable in the invention.

The dimensions of the first and second flat surface members are important, though not critical. Generally, each surface member is from about seven inches to about fifteen inches in width and about ten inches to about eighteen inches in length. Preferred flat surface members range from about eight inches to about twelve inches in width and from about twelve inches to about sixteen inches in length. The first and second flat surface members preferably each have the same width and length for appearance and manufacturing purposes, though this uniformity is not required.

A pocket structure 20 is attached to an underside of either flat surface member. The pocket structure 20 has a bottom wall 21 and side walls 22 and 23. It is open-sided on lower side and an inside side. The pocket structure provides a means to temporarily hold the auxiliary desk top article onto the student desk. The depth of the pocket structure is slightly greater than the depth of the work surface arm of the student desk, generally about one-half inch to about one inch. Sufficient tolerance must be present to readily slip the pocket structure over the student desk's work surface arm, yet not so great as to cause an unstable condition during use. Any attachment means can be used to permanently hold the pocket structure to the flat surface member's underside, including adhesives and screws. A pivoting attachment means is also useable and does allow added freedom in swinging the surface members to a desired writing position or angle.

As shown, the pocket structure is attached to the right side flat surface member 16 since most student desks have right hand work surface arms. The pocket structure is attached to the left side flat surface member 15 when a left handed version of the article is desired.

The width of the pocket structure ranges from about two inches to about ten inches, preferably from about four inches to about eight inches. The length of the pocket structure ranges from about two inches to about ten inches, preferably about four inches to about eight inches.

Figure 3:
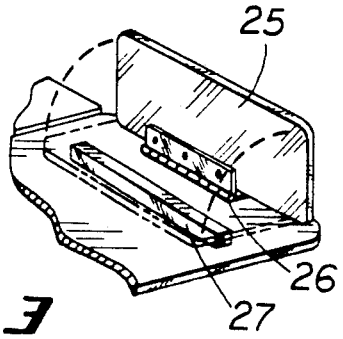
FIG. 3 is a perspective view in detail of a book prop feature found on the portable auxiliary desk top article of FIG. 1.

The portable auxiliary desk top article of FIGS. 1-4 has two optional features which enhance its use. One feature is a book prop. As best seen in FIG. 3, a third substantially rigid flat surface member 25 is hingeably attached to a top lateral edge of the flat surface member 16. A continuous hinge 26 is used for this purpose. The third flat member 25 is hinged to swing approximately 90 degrees from the face of the flat surface member 16 to a substantially upright position. An elongated strip member 27 attached to the face of the flat surface member 16 is provided to act cooperatively with the third flat surface member to act as a book prop. A book is propped with a lower edge abutting against the elongated strip 27 and a backside resting against the third flat surface member 25. Preferably the third flat surface member is about seven inches to about fifteen inches in width and about three inches to about twelve inches in length.

The second optional feature is a pencil stop located preferably on an opposite flat surface member 15. The pencil stop is an elongated strip member 28 attached to the face of the flat surface member 15 at or near a lower lateral edge. The elongated member provides as an obvious function a means of retaining pencils and other writing instruments on the work surface area of the auxiliary desk top article. It also acts to counteract the elongated strip member 27 associated with the book prop such that when the first and second flat surface members are folded together the resultant unit is compact with no wobble.

In operation, the portable auxiliary desk top article is carried by the student to a classroom in a closed state for convenience reasons. Once at the student desk, the student is able to slip the pocket structure of the article over the work surface arm of the desk. The student then folds out the flat surface member opposite the member with the pocket to present a full work surface of both first and second flat surface members. If desired, the third flat surface member is flipped up to serve as a book prop.

While the invention has been described in detail with particular reference to the drawings, it should be understood other obvious variations and modifications of the article are possible. All such variations and modifications are considered within the scope of the appended claims.

I claim:

1. A portable auxiliary desk top article for use on a student desk to enlarge a work surface area of the desk, said auxiliary desk top article comprising a first substantially rigid flat surface member and a second substantially rigid flat surface member hingedly attached together so as to be capable of folding together, wherein one flat surface member has a pocket structure attached to an underside, said pocket structure having a bottom wall and two adjacent side walls and further being open-sided on two adjacent sides such that the pocket structure can be slipped over a work surface arm of the student desk and remain there so as to hold the flat surface member in place and further wherein folding out of the second flat surface member forms the enlarged work surface area.

2. The portable auxiliary desk top article of claim 1 wherein the first and second flat surface members are hingeably attached at longitudinal edges.

3. The portable auxiliary desk top article of claim 2 wherein the first and second flat surface members are hingeably attached by two butt hinges spaced apart.

4. The portable auxiliary desk top article of claim 2 wherein the first and second flat surface members are hingeably attached by a continuous hinge.

5. The portable auxiliary desk top article of claim 2 wherein the first and second flat surface members are hingeably attached by an elongated flexible polymeric material wherein each edge of the polymeric material is secured to a surface member.

6. The portable auxiliary desk top article of claim 2 further comprising a third substantially rigid flat surface member hingeably attached to one of the first or second flat surface members at a top lateral edge such that it is capable of moving through an approximate 90 degree arc from the first or second flat surface member to a substantially upright position, said third flat surface member acting as a book prop.

7. The portable auxiliary desk top article of claim 6 further comprising a book prop elongated strip member attached to the first or second flat surface member to cooperatively act with the third substantially rigid flat surface member to hold a book in a substantially upright position.

8. The portable auxiliary desk top article of claim 7 further comprising a second elongated strip member on the first or second flat surface member opposite the flat surface member with the book prop elongated strip member and near a lower lateral edge thereof to aid in holding pencils in place and to provide an offset to the book stop elongated strip member such that when the first and second flat surface members are folded together they form a compact unit free of wobble.

9. The portable auxiliary desk top article of claim 2 wherein the first and second flat surface members are each from about seven inches to about fifteen inches in width and from about ten inches to about eighteen inches in length.

10. The portable auxiliary desk top article of claim 9 wherein the first and second flat surface members are each from about eight inches to about twelve inches in width and from about twelve inches to about sixteen inches in length.

11. The portable auxiliary desk top article of claim 9 wherein the pocket structure is from about two inches to about ten inches in width and from about two inches to about ten inches in length.

12. The portable auxiliary desk top article of claim 11 wherein the pocket structure is positioned near a top lateral edge and the hingeable edge of one of the first or second flat surface members for optimum support during use.

13. The portable auxiliary desk top article of claim 12 further wherein the pocket structure is open-sided at a lower side and an inside side for ease of slipping the auxiliary desk top article onto the work surface arm of the student desk.

14. The portable auxiliary desk top article of claim 6 wherein the third substantially rigid flat surface member is from about seven inches to about fifteen inches in width and from about three inches to about twelve inches in length.

15. A portable auxiliary desk top article for use on a student desk to enlarge a work surface area of the desk, said auxiliary desk top article comprising a first substantially rigid flat surface member and a second substantially rigid flat surface member hingeably attached together so as to be capable of folding together wherein each said first and second flat surface member is from about seven inches to about fifteen inches in width and from about ten inches to about eighteen inches in length, further wherein one flat surface member has a pocket structure about two inches to about ten inches in width and about two inches to about ten inches in length attached to an underside, said pocket structure having two adjacent side walls and two adjacent sides which are open such that the pocket structure can be slipped over a work surface arm of the student desk ad remain there so as to hold the flat surface member in place and further wherein folding out of the second flat surface member forms the enlarged work surface area.

16. The portable auxiliary desk top article of claim 15 wherein the first and second flat surface members are each from about eight inches to about twelve inches in width and from about twelve inches to about sixteen inches in length.

17. The portable auxiliary desk top article of claim 16 wherein the pocket structure is positioned near a top lateral edge and the hingeable edge of one of the first or second flat surface members for optimum support during use.

18. The portable auxiliary desk top article of claim 17 further wherein the pocket structure is open-sided at a lower side and an inside side for each of slipping the auxiliary desk top article onto the work surface arm of the student desk.

19. The portable auxiliary desk top article of claim 18 wherein he first and second flat surface members are hingeably attached at longitudinal edges.

* * * * *